US005248142A

United States Patent [19]

Breeding

[11] Patent Number: 5,248,142

[45] Date of Patent: Sep. 28, 1993

[54] METHOD AND APPARATUS FOR A WAGERING GAME

[75] Inventor: John G. Breeding, St. Louis Park, Minn.

[73] Assignee: Shuffle Master, Inc., Eden Prairie, Minn.

[21] Appl. No.: 992,090

[22] Filed: Dec. 17, 1992

[51] Int. Cl.[5] ..... A63F 1/00

[52] U.S. Cl. ..... 273/138 R; 273/274; 273/292; 273/309

[58] Field of Search ..... 273/138 R, 274, 292, 273/309

[56] References Cited

U.S. PATENT DOCUMENTS

| | | | |
|---|---|---|---|
| 3,998,462 | 12/1976 | Goott | 273/274 |
| 4,807,884 | 2/1989 | Breeding | 273/149 R |
| 4,861,041 | 8/1989 | Jones et al. | 273/292 |
| 5,078,405 | 1/1992 | Jones et al. | 273/309 |
| 5,098,107 | 3/1992 | Boylan et al. | 273/292 |
| 5,154,429 | 10/1992 | Le Vasseur | 273/292 |

OTHER PUBLICATIONS

Over/Under 13 Blackjack, Gaming Concepts, Inc., 1988.

*Primary Examiner*—Benjamin H. Layno
*Attorney, Agent, or Firm*—Dorsey & Whitney

[57] ABSTRACT

A method of playing a wagering game, such as pai gow poker, is provided. The method involves playing the game according to its generally accepted set of rules and procedures, to its usual wager-resolving outcome, and making an additional wager having an additional wager-resolving outcome, wherein the additional wager is related to one of the procedures. An apparatus for playing the wagering game includes a typical game playing surface with an additional wagering area, a device for randomly selecting a symbol according to the generally accepted set of rules and procedures, and a display device for displaying the symbol. The additional wager relates to the randomly selected symbol.

9 Claims, 3 Drawing Sheets

METHOD AND APPARATUS FOR A WAGERING GAME

TECHNICAL FIELD

The present invention relates to wagering games and to a method for making side bets related to such games. In particular, it relates to a method and apparatus for playing a wagering game, wherein the game is pai gow poker and includes a side bet method.

BACKGROUND ART

There are many wagering games used for gambling. Generally, it is desirable that such wagering games be relatively uncomplicated so that they can be understood easily by players. The games should be exciting to arouse players' interest. It is also desirable that the games can be played rapidly to their wager-resolving outcome. Rapid play and wager resolution enhances players' interest and enjoyment because betting opportunities are increased. Wagering games should provide reasonable odds in favor of the players, yet favor the casino, house, dealer or banker, and also meet the requirements of regulatory agencies.

One such game is pai gow, a Chinese tile game. It has been adapted into pai gow or Asian poker, the tiles being replaced by typical, well-known playing cards. According to an article in the April, 1992 issue of WIN, casinos in the United States began offering pai gow poker in the 1980's.

U.S. Pat. No. 4,659,087 (to Shen et al.) discloses a casino card game somewhat similar to pai gow poker in that each player makes or sets two groups of cards in a hand, in that dice are used to determine the first card to be dealt, and in that to win, both groups of cards in a hand must be higher than the banker's cards. The casino card game disclosed by Shen et al. is unlike pai gow poker and the present invention in that the number of cards per hand is different, there is no procedure to determine to which player the first hand should be dealt, and in that there is no side bet method disclosed or suggested.

The game disclosed by Shen et al., pai gow poker, and other Asian games are becoming increasingly popular because they are not hard to learn, play and wager-resolution are fairly fast, and they are exciting. Nevertheless, games such as the Shen et al. game, pai gow poker, Carribean Stud TM poker and others include random events or random event-based procedures in addition to their usual wager-resolving outcomes and this type of game could be made even more exciting by providing the opportunity for players to make additional wagers on procedural events involving random events inherent in the rules and procedures of the games.

Ways to provide wagering games with additional wagering opportunities are known. For example, U.S. Pat. Nos. 4,861,041 and 5,087,405 (both to Jones et al.) disclose methods and apparatus for progressive jackpot gaming, respectively. The former patent discloses that a player may make an additional wager at the beginning of a hand, the outcome of the additional wager being determined by the appearance of a predetermined arrangement of cards in the player's hand. The apparatus includes a progressive meter for displaying the amount of the progressive jackpot. In contrast to the side bet method of the present invention, the progressive jackpot additional wager is unrelated to the procedures of the game being played, and requires interested players to learn yet another rule and arrangement of cards. Substantial modifications of the usual or typical casino gaming table are also required.

U.S. Pat. No. 5,098,107 (to Boylan et al.) discloses another method and apparatus for a wagering game wherein additional symbols, a number of no value cards or balls, are added to the usual means of playing the game. An additional wager, based on the chance appearance of symbols while playing the game, is made. The wagering game according to the Boylan et al. reference could include pai gow poker and, in one version of the Boylan et al. game, chance appearance bets would be made prior to dealing any cards. In contrast, the wagering game of the present invention does not require any additional symbols or rules in excess of or different than the symbols and rules usually associated with the game. Nonetheless, the side betting method, and apparatus, of the present invention serves to increase players' excitement and interest in the game.

The rapid play of wagering games such as pai gow poker generates another problem. When combined with relatively large hands (seven cards in pai gow poker) and many players (up to seven in pai gow poker), rapid play causes a lot of shuffling and dealing time to the detriment of players' excitement and interest. Some of this time can be recovered by using shuffling machines such as the machine disclosed in U.S. Pat. No. 4,807,884 (invented by the inventor of the present invention and commonly owned).

Playing and wagering time can be increased in other ways as well. U.S. Pat. No. 5,154,429 (to LeVasseur) discloses a modified version of a wagering game, specifically blackjack or twenty-one, wherein the dealer plays multiple hands against a player's single hand, whereby the number of hands played in the same amount of time is increased. After the first hand played in the conventional manner, the dealer picks up all of the dealer's cards except the first. The dealer then plays a second hand against a player's first or existing hand. Unlike the present invention, the LeVasseur modified game simply provides more of the usual wager-resolving outcomes. There is no disclosure or suggestion about how to provide new, additional wagering opportunities based on random events, if any, intrinsic to the game.

SUMMARY OF THE INVENTION

The problems and desired attributes outlined above are in large measure solved and accomplished, respectively, by the method and apparatus for a wagering game in accordance with the present invention.

The method of the present invention broadly involves improving a wagering game having a generally accepted and well recognized set of rules and procedures, and a wager-resolving outcome. In the preferred embodiment of the present invention the game is pai gow poker, also known as Asian poker. The method comprises playing the wagering game according to its accepted rules and procedures, yet giving players the option of making an additional wager having an additional wager-resolving outcome. The additional wager is related directly to one of the usual procedures of the game, yet does not affect or change the accepted set of rules or the usual wager-resolving outcome. The method of the present invention may also be used with any other appropriate wagering games such as Caribbean Stud TM poker.

The present invention also includes apparatus for playing the wagering game according to the method of the present invention, wherein a typical gaming table, having a playing surface, is slightly modified to include a specific area that provides means for making the additional wager and means for displaying the additional wager-resolving outcome to the players and to the dealer. The apparatus may also include a card shuffling machine such as that disclosed in U.S. Pat. No. 4,807,884 (invented by the inventor of the present invention and commonly owned) for facilitating and speeding the play of the wagering game, particularly in the instance of pai gow poker. A display device may also be associated with the apparatus for displaying the additional wager-resolving outcome.

It is an object of the present invention to provide an exciting and interesting wagering game that is easy to learn.

Another object of the present invention is to provide a wagering game that is rapidly played to its usual wager-resolving outcome, and includes one or more random events upon which an additional wager can be made without detrimentally slowing the play of the game.

It is another object of the present invention to introduce into a known wagering game, such as pai gow poker, an additional wager to increase the excitement involved in playing the game, without affecting or complicating the generally well-known, accepted rules of the game.

It is an object of the present invention to provide an exciting wagering game, made even more exciting by making an additional wager related to one of the procedures of the wagering game, yet unrelated to the usual wager-resolving outcome, wherein the additional wager does not change the rules of the game.

It is another object of the present invention to provide for an additional wager in a pai gow poker game, wherein the additional wager is related to a random event, an intrinsic part of the procedure or flow of the game, specifically, the random selection of a symbol designating which of the players of the game shall receive the first hand.

It is an advantage of the present invention that providing the already exciting pai gow poker game with the opportunity for players to make an additional wager will enhance players' enjoyment of the game, increase the excitement of the game, and increase the amounts wagered.

DETAILED DESCRIPTION OF THE PREFERRED EMBODIMENT

Figure 1:
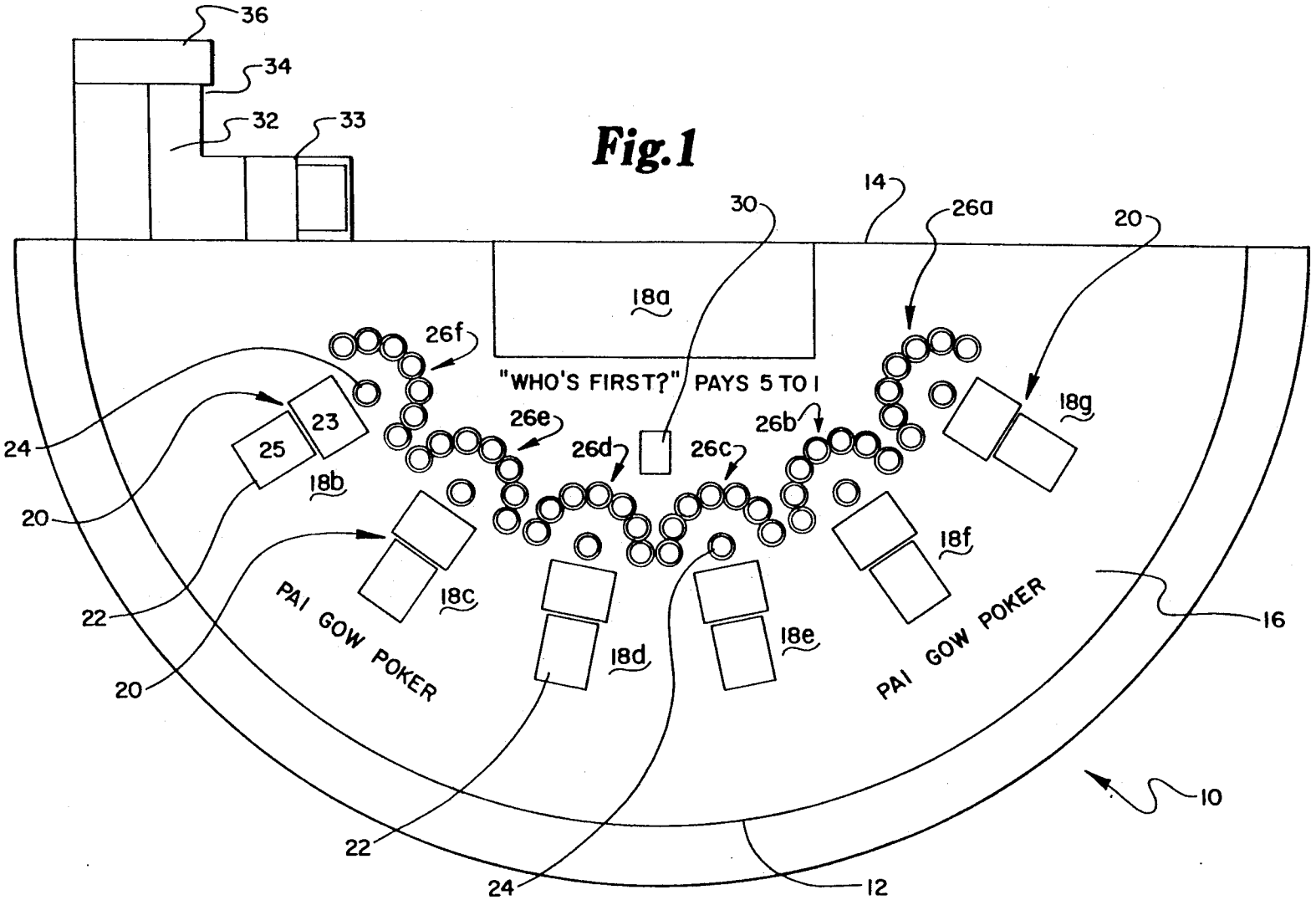
FIG. 1 depicts the apparatus for use in practicing the method of the present invention.

Referring to FIG. 1, the apparatus for the wagering game of the present invention includes a typical casino gambling or gaming table 10. The table 10 has a curved side 12 for accommodating up to six players and a straight side 14 for accommodating the house dealer. The table 10 has a playing surface 16 covered with felt or other appropriate surfacing materials. Seven playing positions or locations 18*a–g* for individual players, including the house dealer 18*a*, are provided.

Figure 2:
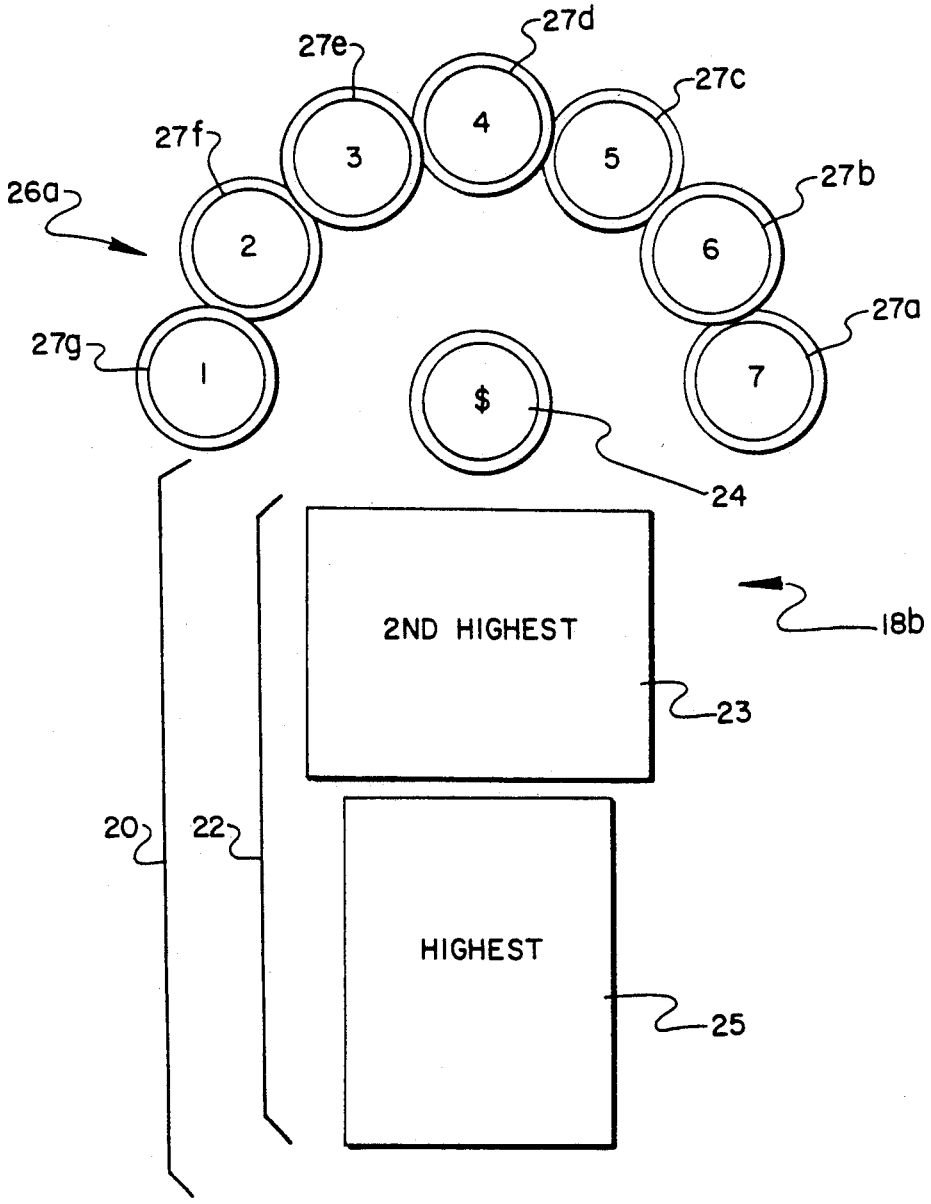
FIG. 2 is a top plan view of a portion of the apparatus, shown enlarged.

Referring to FIG. 2, wherein position 18*b* is shown enlarged and as representative of the playing positions 18*b–g*, each playing position 18*b–g* has a first wagering area 20, including a card displaying area 22 and a wager placing and displaying area 24. The card area 22 is split into a front hand area 23 and a rear hand area 25. Each playing location 18*b–g* also includes a second wagering area 26*a–f* for use in placing the additional wager of the present invention. Each second wagering area 26*a–f* includes seven wager placing indicators 27*a–g* for receiving wager means, such as chips (not shown) or other appropriate indicators.

Referring back to FIG. 1, the straight side 14 of the table 10 includes a dealer or house playing station 18*a*. Between the dealer station 18*a* and the other player locations 18*b–g*, the apparatus of the present invention includes a dealer readable, digital display means 30. At the right side of the dealer station 18*a*, the apparatus includes a microprocessor or computer controlled shuffling machine 32 supported by a table extension 34. The shuffling machine 32 is of the type disclosed in U.S. Pat. No. 4,807,884 (invented by the inventor of the present invention and commonly owned), the disclosure of which patent is incorporated herein by reference. The shuffling machine 32 may include a dealing module 33 for automatically and sequentially dealing or forming the seven hands, each having seven cards, used in pai gow poker. The apparatus of the present invention also may include a player readable display means 36 coupled to the shuffling machine 32.

In the preferred embodiment of the present invention the wagering game is pai gow or Asian poker. The game is played with a single deck or pack of cards with a maximum number of seven players, including the dealer or house as one of the players. Up to six players play or bet against the dealer, who controls the shuffling and dealing of the cards, directs the flow of the game and resolves the wagers, including the wagers on both the usual, final wager-resolving outcome of the game and the additional wager of the method of the present invention. Play is in the counter-clockwise direction.

In pai gow poker, the shuffled deck is dealt into seven hands of seven cards each. If cards are being dealt by hand, the dealer deals the seven hands in the usual manner, i.e., by dealing one card to each hand sequentially until each hand has seven cards. If a machine is being used, as in the preferred embodiment of the present invention, the seven cards comprising each hand are dealt consecutively to that hand before dealing to the next hand, until all hands have been dealt. The remaining cards of the deck, and any unused hands, are stored in a discard tray or rack until the game is over.

An interesting, exciting feature of pai gow poker is that the player to receive the first hand of seven cards is randomly selected. The typical way of randomly selecting the first player to receive cards is by throwing three dice. Other suitable means, such as using a spinner bearing letters, numbers or other symbols designating one of the seven playing positions, or, as in the present invention, using a computer or microprocessor to select randomly a number designation, might be used. Once the first player to receive a hand is selected, the deal proceeds. Each player sets up two hands, a front or two-card hand and a back or five-card hand. The object of the wager-resolving outcome of pai gow poker is for a player to set each of the front and back hands in higher conventional poker hand rankings than the dealer's. If both of a player's two-card hand and five-card hand outrank those of the dealer, that player wins the amount wagered. A player must lose both the front and back hands to the dealer to lose a wager. In the event that one of the hands of a player is higher and the other lower than the respective hands of the dealer, then there is a stand-off or "push", and the amount wagered by that player stands. A player's back or five-card hand must always have a higher value than the front hand. Each player may set or arrange the two hands in any conventional poker ranking, but a fouled hand loses to the dealer.

Usually, betting or wagering on the wager-resolving outcome of pai gow poker takes place before cards or hands are revealed. Once betting is closed, the cards are distributed starting with the randomly selected first player and proceeding clockwise. The players set their hands as outlined above. Cards are revealed and compared to the dealer's who then resolves the wagers. When all the wagers are resolved, the hand is over. The deck is reshuffled or another preshuffled deck may be taken from the shuffling machine 32 or moved in to the dealing module 33 if they are is being used, and another hand begun as outlined above.

Figure 3:
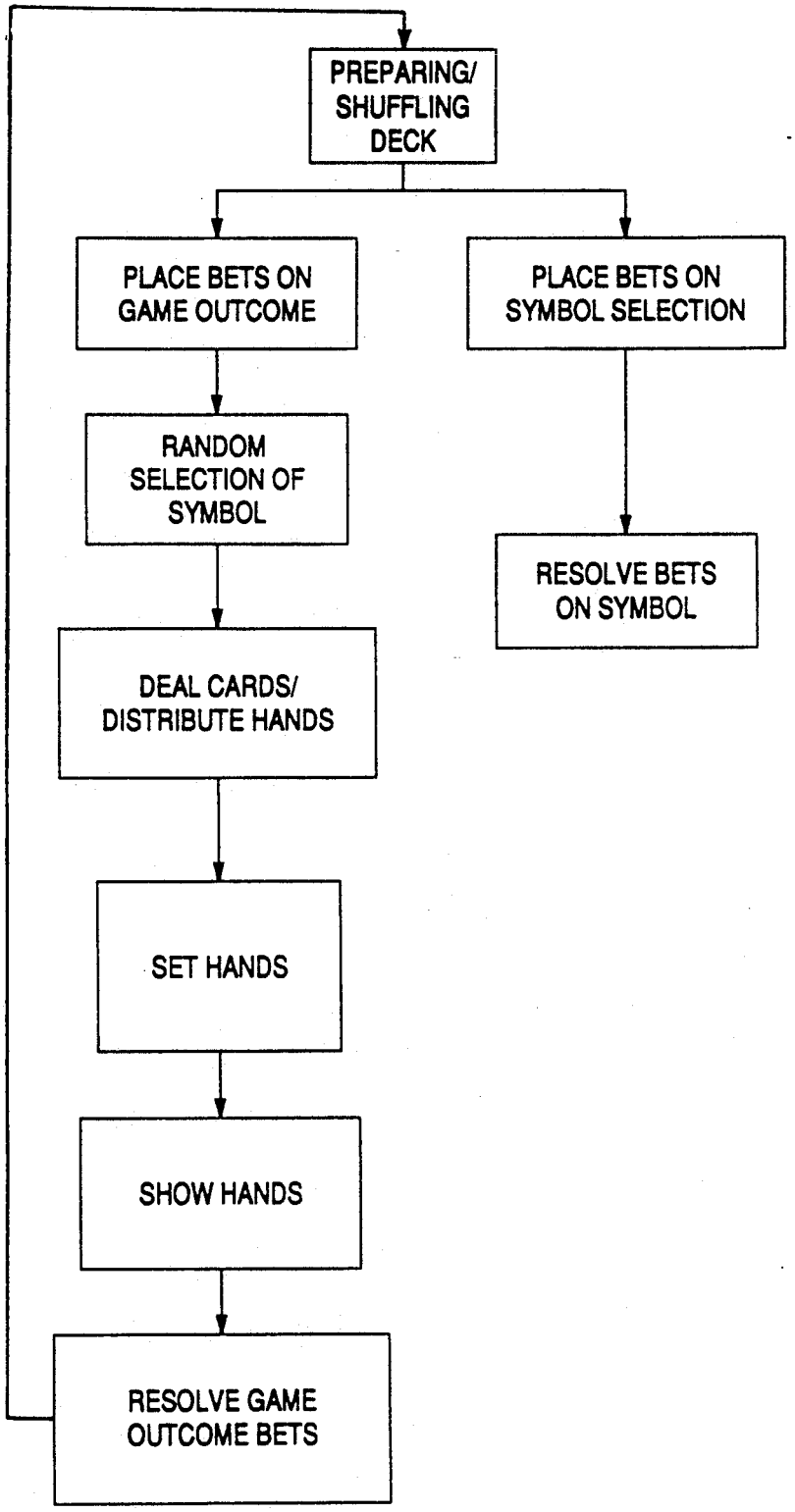
FIG. 3 is a block diagram representing the play flow of the wagering game of the present invention.

Referring to the flow diagram of FIG. 3, the initial step in playing the game is preparing or shuffling a deck of cards, block 38, by activating the shuffling machine 32 or hand-shuffling a deck to provide a shuffled deck. The additional wager or side betting method of the present invention relates directly to the pai gow poker step of randomly selecting or designating the first player to receive cards, block 44. More specifically, as shown at block 42, before the hand starts each player may place a bet, in addition to placing the usual wager on the game outcome, block 40, on the random selection of the first player to receive the first hand. Referring to FIG. 1, those players wishing to participate in the additional wager place the amount to be wagered in their respective additional wagering area 26*a–f* by placing chips or other wagering means reflecting the amount they are willing to bet on one of the seven indicators 27*a–g*. When both the usual game outcome bets and the additional wagers are in, the dealer activates the shuffling machine 32 or dealing module 33. Starting either, if they are being used, activates a random number selection portion of the program of the microprocessor (not shown) that controls the shuffling machine 32 and dealing module 33. Before the first seven card hand is dealt, the microprocessor selects a number from 1–7 designating one of the players or the dealer and displays it on the display 36 and the dealer readable display 30. The additional wagers regarding which player designation will be randomly selected are resolved, block 46, before the distribution of the first and subsequent hands, block 48. The hands are set by the players, block 50, displayed, block 52, and the game outcome wagers resolved, block 54. Play then returns to block 38, and a new hand is played as outlined and shown in FIG. 3.

The method of the present invention is not limited to pai gow poker, but may be applied or used in other appropriate games such as Caribbean Stud TM poker. The apparatus for the side betting method of the present invention does not have to include a shuffling machine 32, dealing module 33, random designator display means 36 and 30, or a microprocessor random designator selector. However, these features of the present invention facilitate and expedite the play of the game, as well as add excitement and appeal to the game being played. The randomly selected symbols of the preferred embodiment are numbers (from 1–7), however, any symbol which understandably designates the player or playing location as the first to receive cards may be used. For example, the means for randomly selecting a designating symbol might send a signal to an indicator light, one of which is located at each playing location. Likewise, any appropriate means of randomly selecting the symbol designating the first player to receive cards may be used. Although in the preferred embodiment the additional wager is resolved before hands are distributed, it could be resolved at the end of the game, along with the resolution of the usual bets on the game outcome. The wagering game of the present invention might be played entirely in interactive electronic or video form, wherein appropriate symbols for cards and wagers would be displayed electronically. A "board-type" game, suitable for home or casino use, may also include the side-betting method of the present invention, as long as there is at least one random event intrinsic in the usual game procedures, and as long as the usual game resolving outcome is not affected by the side bet.

The present invention may be embodied in other specific forms without departing from the essential spirit or attributes thereof. It is therefore desired that the described embodiments may be considered in all respects as illustrative, not restrictive, reference being made to the appended claims rather than to the foregoing description to indicate the scope of the invention.

What is claimed is:

1. A method of playing a wagering game played by a dealer and a plurality of players comprising the steps of:

providing playing means having a plurality of different gaming symbols;

providing a plurality of wagering means;

providing a game surface having a plurality of wagering areas, one for each player, each wagering area having a first wager placing area and a second wager placing area, said second wager placing area having a plurality of wager placing indicators being equal to the number of said wagering areas, a plurality of unique symbols, each unique symbol designating a different one of said players, each said wager placing indicator having one of said unique symbols thereon;

providing a random unique symbol selecting means for randomly selecting one of said unique symbols, and a display means for displaying said randomly selected unique symbol;

each player placing a first wager on which player will be first player to be dealt gaming symbols by placing wagering means on the corresponding wager placing indicator in their second wager placing area;

said dealer randomly selecting one of said unique symbols by operating said random unique symbol selecting means, said player corresponding to the selected unique symbol being the first player to receive said gaming symbols;

said dealer resolving said first wagers by paying out players that correctly wagered on which player would be said first player and collecting from players that did not correctly wager on said first player;

said dealer distributing said gaming symbols to each player and the dealer, beginning with said first player;

after distribution, allowing said players and dealer to arrange their gaming symbols in a predetermined relationship, wherein a plurality of different gaming symbol relationships are defined, each being given a relative rank;

players placing a second wager on the rank of their gaming symbols relative to the rank of the dealer's gaming symbols by placing wagering means in said first wager placing area;

said dealer and players revealing their gaming symbols;

said dealer resolving said second wager by paying out players that correctly wagered that the rank of their gaming symbol relationship beat the dealer's rank and collecting from wagering players that had a gaming symbol relationship rank that did not beat the dealer's rank.

2. The method according to claim 1, wherein said playing means comprises cards each having said gaming symbols.

3. The method according to claim 2, wherein said unique symbol is randomly generated by a microprocessor.

4. The method according to claim 3, wherein said symbol is a number randomly selected from the numbers one through seven.

5. Apparatus for playing a wagering game played by a dealer and a plurality of players comprising:

playing means having a plurality of different gaming symbols;

a plurality of wagering means;

a game surface having a plurality of wagering areas, one for each player, each wagering area having a first wager placing area and a second wager placing area, said second wager placing area having a plurality of wager placing indicators being equal to the number of wagering areas, a plurality of unique symbols, each unique symbol designating a different one of each player, each said wager placing indicator having one of said unique symbols thereon; and a random unique symbol selecting means for randomly selecting one of said unique symbols, and having a display means for displaying said randomly selected unique symbol.

6. The apparatus according to claim 5, wherein said unique symbols comprise the numerals one through seven.

7. The apparatus according to claim 6, wherein said game surface comprises the playing surface of a gaming table.

8. The apparatus according to claim 7, wherein said game playing means are playing cards having said gaming symbols and said wagering means are chips.

9. The apparatus according to claim 5 shuffling means for shuffling said game playing means, said shuffling means being controlled by a microprocessor also programmed to randomly select one of said unique symbols and to control said display means to display said randomly selected symbol.

* * * * *